US005951013A

United States Patent [19]

Campanella

[11] Patent Number: 5,951,013

[45] Date of Patent: Sep. 14, 1999

[54] CARD BATTLE GAME

[76] Inventor: Christopher Campanella, 1841 77th St., Brooklyn, N.Y. 11214

[21] Appl. No.: 09/041,429

[22] Filed: Mar. 12, 1998

[51] Int. Cl.[6] ..... A63F 1/00

[52] U.S. Cl. ..... 273/308; 273/303

[58] Field of Search ..... 273/303, 308, 273/292

[56] References Cited

U.S. PATENT DOCUMENTS

| | | | |
|---|---|---|---|
| 1,139,356 | 5/1915 | Fields | 273/308 X |
| 4,243,226 | 1/1981 | Kendall | 273/308 X |
| 5,213,334 | 5/1993 | Yih | 273/308 X |
| 5,435,568 | 7/1995 | Black | 273/308 X |

*Primary Examiner*—Raleigh W. Chiu

[57] ABSTRACT

A new card battle game for providing a game of chance and strategy involving nature's elements. The inventive device includes a plurality of nature cards including elements of fire, earth, metal, water and wood wherein fire destroys metal, metal cuts down wood, wood covers earth, earth absorbs water, and water puts out fire. Next, a plurality of advanced cards are provided. The advanced cards include force of nature, chaos, and anger of the gods wherein the force of nature counters any nature card, the chaos card counters the force of nature card or forces the removal of any nature card, and the anger of the gods card destroys all nature cards in play.

1 Claim, 2 Drawing Sheets

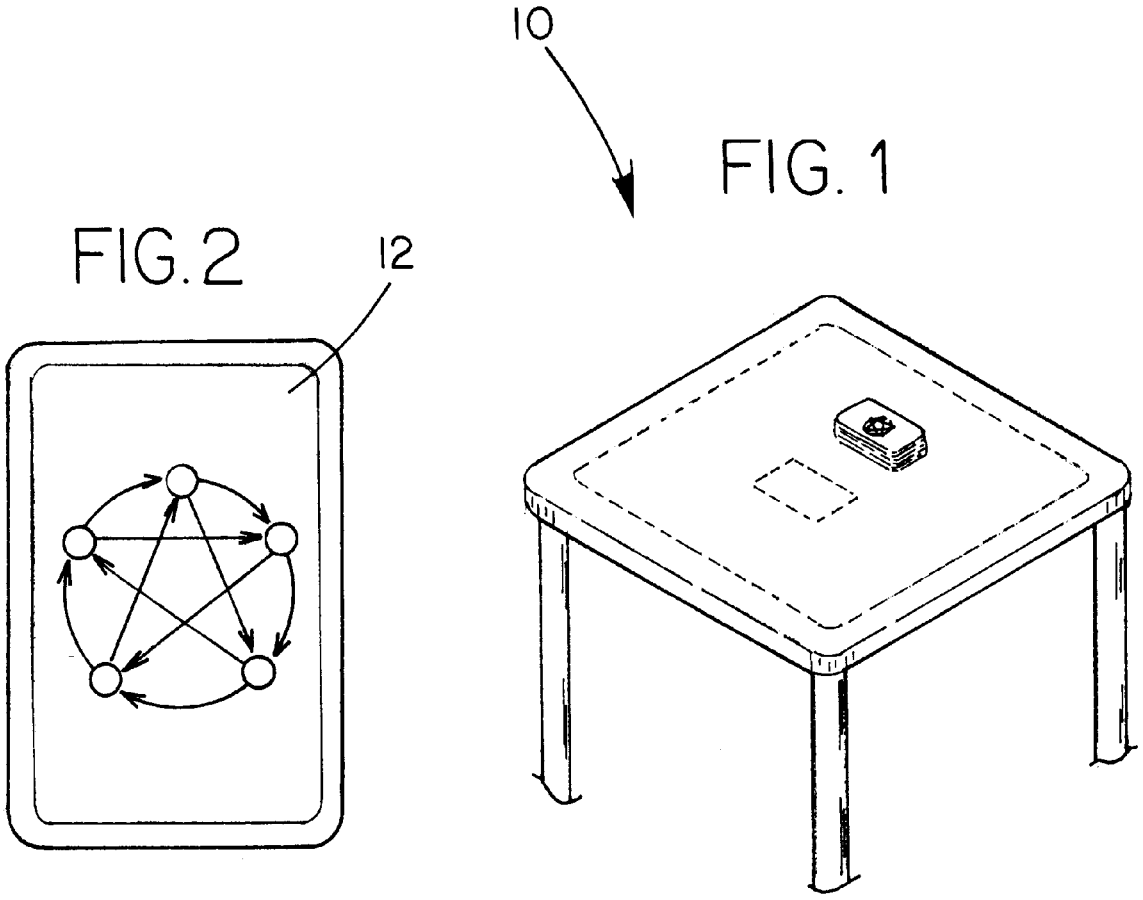
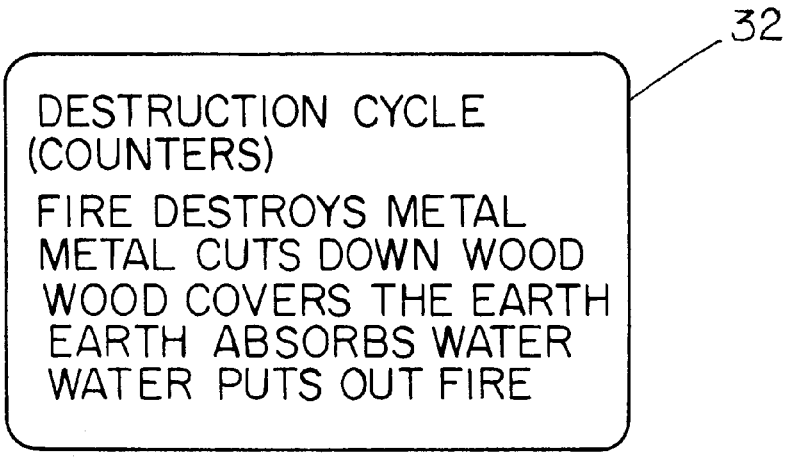
FIG. 3

CARD BATTLE GAME

BACKGROUND OF THE INVENTION

1. Field of the Invention

The present invention relates to card and board games and more particularly pertains to a new card battle game for providing a game of chance and strategy involving nature's elements.

2. Description of the Prior Art

The use of card and board games is known in the prior art. More specifically, card and board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art card and board games include U. S. Pat. No. 4,221,389 to Read; U.S. Pat. No. 5,449,177 to Naylor; U.S. Pat. No. Des. 310,248 to Leite; U.S. Pat. No. 4,016,939 to Thron; U.S. Pat. No. 5,026,070 to Watt; and U.S. Pat. No. 4,946,169 to Hofmann.

While these devices fulfill their respective, particular objectives and requirements, the aforementioned patents do not disclose a new card battle game. The inventive device includes a plurality of nature cards including elements of fire, earth, metal, water and wood wherein fire destroys metal, metal cuts down wood, wood covers earth, earth absorbs water, and water puts out fire. Next, a plurality of advanced cards are provided. The advanced cards include force of nature, chaos, and anger of the gods wherein the force of nature counters any nature card, the chaos card counters the force of nature card or forces the removal of any nature card, and the anger of the gods card destroys all nature cards in play.

In these respects, the card battle game according to the present invention substantially departs from the conventional concepts and designs of the prior art, and in so doing provides an apparatus primarily developed for the purpose of providing a game of chance and strategy involving nature's elements.

SUMMARY OF THE INVENTION

In view of the foregoing disadvantages inherent in the known types of card and board games now present in the prior art, the present invention provides a new card battle game construction wherein the same can be utilized for providing a game of chance and strategy involving nature's elements.

The general purpose of the present invention, which will be described subsequently in greater detail, is to provide a new card battle game apparatus and method which has many of the advantages of the card and board games mentioned heretofore and many novel features that result in a new card battle game which is not anticipated, rendered obvious, suggested, or even implied by any of the prior art card and board games, either alone or in any combination thereof.

To attain this, the present invention generally comprises a plurality of nature cards including elements of fire, earth, metal, water and wood wherein fire destroys metal, metal cuts down wood, wood covers earth, earth absorbs water, and water puts out fire. Next, a plurality of advanced cards are provided. The advanced cards include force of nature, chaos, and anger of the gods wherein the force of nature counters any nature card, the chaos card counters the force of nature card or forces the removal of any nature card, and the anger of the gods card destroys all nature cards in play.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new card battle game apparatus and method which has many of the advantages of the card and board games mentioned heretofore and many novel features that result in a new card battle game which is not anticipated, rendered obvious, suggested, or even implied by any of the prior art card and board games, either alone or in any combination thereof.

It is another object of the present invention to provide a new card battle game which may be easily and efficiently manufactured and marketed.

It is a further object of the present invention to provide a new card battle game which is of a durable and reliable construction.

An even further object of the present invention is to provide a new card battle game which is susceptible of a low cost of manufacture with regard to both materials and labor, and which accordingly is then susceptible of low prices of sale to the consuming public, thereby making such card battle game economically available to the buying public.

Still yet another object of the present invention is to provide a new card battle game which provides in the apparatuses and methods of the prior art some of the advantages thereof, while simultaneously overcoming some of the disadvantages normally associated therewith.

Still another object of the present invention is to provide a new card battle game for providing a game of chance and strategy involving nature's elements.

Yet another object of the present invention is to provide a new card battle game which includes a plurality of nature cards including elements of fire, earth, metal, water and wood wherein fire destroys metal, metal cuts down wood, wood covers earth, earth absorbs water, and water puts out fire. Next, a plurality of advanced cards are provided. The advanced cards include force of nature, chaos, and anger of the gods wherein the force of nature counters any nature card, the chaos card counters the force of nature card or forces the removal of any nature card, and the anger of the gods card destroys all nature cards in play.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new card battle game according to the present invention illustrated on a playing table.

FIG. 2 is a front view of a back side of the playing cards of the present invention.

FIG. 3 is an illustration of a sample of the rules of the present invention.

DESCRIPTION OF THE PREFERRED EMBODIMENT

Figure 4:
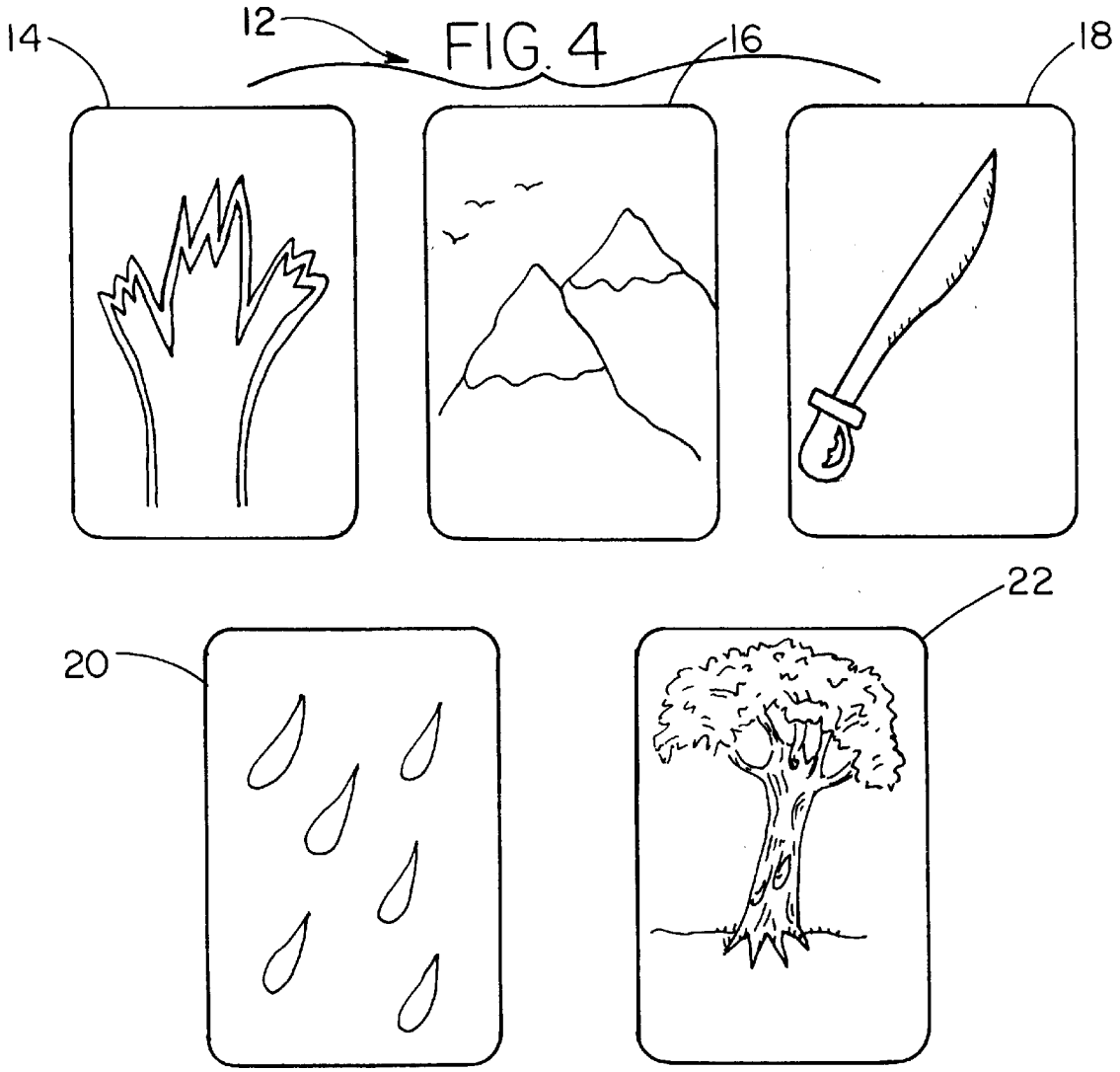
FIG. 4 is a front view of the fire, earth, water, metal and wood cards of present invention.
Figure 5:
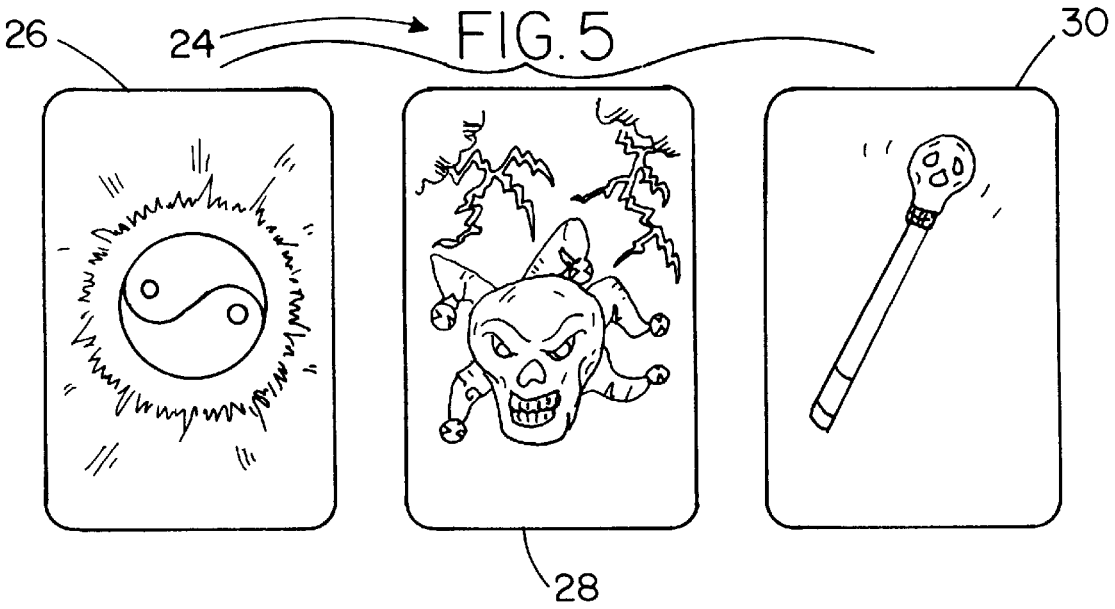
FIG. 5 is a front view of the force of nature, chaos and anger of the gods cards of the present invention.

With reference now to the drawings, and in particular to FIGS. 1 through 5 thereof, a new card battle game embodying the principles and concepts of the present invention and generally designated by the reference numeral 10 will be described.

As best illustrated in FIGS. 1 through 5, the card battle game 10 comprises a plurality of nature cards 12 including elements of fire 14, earth 16, metal 18, water 20 and wood 22 wherein fire 14 destroys metal 18, metal 18 cuts down wood 22, wood 22 covers earth 16, earth 16 absorbs water 20, and water 20 puts out fire 14.

Next, a plurality of advanced cards 24 are provided. The advanced cards 24 include force of nature 26, chaos 28, and anger of the gods 30 wherein the force of nature 26 counters any nature card 12, the chaos card 28 counters the force of nature card 26 or forces the removal of any nature card 12, and the anger of the gods card 30 destroys all nature cards 12 in play.

The game can be played by two to four players. There are five elements or powers that control nature. They are fire, earth, metal, water, and wood. Each player attempts to get one of each in order to win the game. In a starter deck, you play with ten of each element making a fifty card deck. Each player is given four cards. The players then flip a coin or roll a die to determine who will begin play. On each turn, a player draws a card from the deck. The player must then either put an element on the playing surface or pass, then discard a card down to four in the hand, and declare that your turn is over. Any other player can counter the card played with a card that counters in the destruction cycle 32. Note FIG. 3. There are no limits on the amount of counters that may be played and players can counter on any turn. When a player uses a card it goes in a discard pile after it is played. This is also done with countered cards. To win you have to declare that you have all five elements. This is done to give the other players a chance to counter any elements before your turn and the game is over. In an advanced version, the force of nature, chaos, and anger of the gods cards are added. All rules are the same but, the force of nature counters any nature card, the chaos card counters the force of nature card or forces the removal of any nature card, and the anger of the gods card destroys all nature cards in play.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new card battle game for providing a game of chance and strategy involving nature's elements comprising, in combination:

a plurality of nature cards including elements of fire, earth, metal, water and wood wherein fire destroys metal, metal cuts down wood, wood covers earth, earth absorbs water, and water puts out fire; and a plurality of advanced cards including force of nature, chaos, and anger of the gods wherein the force of nature counters any nature card, the chaos card counters the force of nature card or forces the removal of any nature card, and the anger of the gods card destroys all nature cards in play.

* * * * *